US010236622B2

(12) United States Patent
Jenkin

(10) Patent No.: US 10,236,622 B2
(45) Date of Patent: Mar. 19, 2019

(54) SUBSEA ELECTRICAL CONNECTOR COMPONENT

(71) Applicant: Siemens Aktiengesellschaft, Munich (DE)

(72) Inventor: Kieran Jenkin, Millom (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/320,819

(22) PCT Filed: Jul. 16, 2014

(86) PCT No.: PCT/EP2014/065278
§ 371 (c)(1),
(2) Date: Dec. 21, 2016

(87) PCT Pub. No.: WO2016/008525
PCT Pub. Date: Jan. 21, 2016

(65) Prior Publication Data
US 2017/0201039 A1 Jul. 13, 2017

(51) Int. Cl.
*H01R 13/523* (2006.01)
*H01R 13/533* (2006.01)
(Continued)

(52) U.S. Cl.
CPC ..... *H01R 13/523* (2013.01); *E21B 33/0385* (2013.01); *H01R 13/533* (2013.01);
(Continued)

(58) Field of Classification Search
CPC ... H01R 13/523; H01R 13/6599; H01R 43/20
(Continued)

(56) References Cited

U.S. PATENT DOCUMENTS 4,371,742 A * 2/1983 Manly ..... H01B 11/146 174/36
4,913,784 A * 4/1990 Bogenschutz ..... H05K 3/381 205/163

(Continued)

FOREIGN PATENT DOCUMENTS

GB 2192316 A 1/1988
GB 2448985 A 11/2008
WO 2008113026 A1 9/2008

OTHER PUBLICATIONS

Fauchais P. et al; "Thermal Sprayed Coatings Used Against Corrosion and Corrosive Wear"; Advanced Plasma Spray Applications, InTech; ISBN: 978-9-53-510349-3; DOI: 10.5772/34448; XP055174116; Mar. 21, 2012.

(Continued)

*Primary Examiner* — Alexander Gilman
(74) *Attorney, Agent, or Firm* — Beusse Wolter Sanks & Maire

(57) ABSTRACT

A component of a subsea electrical connector, the component is made of an electrically insulating material. The component includes a protective coating applied to at least a portion of the electrically insulating material for preventing water permeation into the electrically insulating material, wherein the protective coating is a ceramic coating A method of manufacturing a component of a subsea electrical connector includes applying a protective coating to at least a portion of the electrically insulating material for preventing water permeation into the electrically insulating material, wherein the protective coating is a ceramic coating.

7 Claims, 3 Drawing Sheets

(51) Int. Cl.
*H01R 13/6599* (2011.01)
*E21B 33/038* (2006.01)
*H01R 43/20* (2006.01)
*E21B 17/02* (2006.01)

(52) U.S. Cl.
CPC ..... *H01R 13/6599* (2013.01); *H01R 43/20* (2013.01); *E21B 17/028* (2013.01)

(58) Field of Classification Search
USPC ..... 439/92
See application file for complete search history.

(56) References Cited

U.S. PATENT DOCUMENTS 4,921,731 A * 5/1990 Clark ..... C03C 17/23 427/314
4,925,394 A * 5/1990 Hayashi ..... H01H 1/021 439/86
5,043,548 A * 8/1991 Whitney ..... B05B 7/1486 219/121.47
6,007,390 A * 12/1999 Cheng ..... C23C 14/0688 428/673
6,156,377 A * 12/2000 Miyasaka ..... C23C 24/04 427/201
6,183,886 B1 * 2/2001 Chen ..... C23C 28/00 148/537
6,454,815 B1 * 9/2002 Finello ..... H01G 9/155 29/25.03
7,195,817 B2 * 3/2007 Lev ..... C23C 16/0272 428/216
7,534,147 B2 * 5/2009 Marklove ..... H01R 13/523 439/675
7,794,254 B2 * 9/2010 Marklove ..... H01R 13/521 439/271
8,628,860 B2 * 1/2014 Refke ..... C23C 4/10 428/632
8,968,018 B2 * 3/2015 Sivik ..... H02G 3/22 439/271
9,527,777 B2 * 12/2016 Chamberlain ..... C04B 41/88
9,640,452 B2 * 5/2017 Tsujino ..... H01L 23/057
2003/0219622 A1 * 11/2003 Niebauer ..... B32B 15/01 428/663
2006/0043644 A1 * 3/2006 Kalman ..... C04B 35/117 264/332
2007/0298270 A1 * 12/2007 Hazel ..... B05D 7/14 428/469
2008/0085395 A1 * 4/2008 Fernihough ..... B23P 6/007 428/131
2008/0227341 A1 * 9/2008 Nicholson ..... E21B 33/0385 439/730
2009/0226742 A1 * 9/2009 Blum ..... C08G 77/38 428/447
2013/0065422 A1 * 3/2013 Van Swearingen ..... H01R 13/629 439/378
2015/0126134 A1 * 5/2015 Lobianco ..... H04B 1/38 455/73
2015/0368822 A1 * 12/2015 Sammelselg ..... C25D 11/18 428/312.8
2016/0141116 A1 * 5/2016 Lee ..... H01G 4/30 29/25.42
2016/0141488 A1 * 5/2016 Gerlach ..... H01L 41/29 310/334
2017/0018892 A1 * 1/2017 Jenkin ..... H01R 13/523
2017/0167373 A1 * 6/2017 Hong ..... C23C 4/11

OTHER PUBLICATIONS

Putnam D.; "(SBIR) Navy—Improved Anti-Corrosion Coatings for Undersea Cable Connectors"; URL:http://www.navysbir.com/n13_1/NI31-034.htm; pp. 1-2; XP055174089; Dec. 17, 2012.
M. Floristán et al.; "Development of electrically conductive plasma sprayed coatings on glass ceramic substrates", Surface & Coatings Technology, journal homepage: www.elsevier.com/locate/surfcoat; 2010.
Giancaterina S. et al; "Photoprotective ceramic coatings on poly(ether ether ketone)"; Polymer, Elsevier Science Publishers B.V.; vol. 43; No. 24; pp. 4397-6405; ISSN: 0032-3861; DOI: 10.1016/S0032-3861(02)00499-8; XP004383525; Nov. 1, 2002.
"Thermal Spray Coatings—A&A Company, Inc.: Non-Conductive Coating in Accordance with NAVSEA S9320-AM-PR0-030/MLDG REV 03"; A&A Company; URL:http://www.thermalspray.com/non-conductive-coating-accordance-navsea-s9320-pro-O30mldg-rev-03/; pp. 1-4; XP055174100/XP055174101; Apr. 15, 2014.
"Submarine Cable Connector Connector Body Coated With Plasma Applied Non-Conductive Ceramic Coating to Prevent Corrosion by Galvanic Action Connector Body Prior to Blasting & NCC Application Connector After NCC Application"; Thermal Spray Solutions; URL:http://www.thermalsprayusa.com/file/AM-PR0-030_NCC_-_Submarine_Cable_Connector_1.pdf; p. 1; XP055174075; Aug. 25, 2011.
International Search Report dated Mar. 12, 2015, for PCT application No. PCT/EP2014/065278.

* cited by examiner

SUBSEA ELECTRICAL CONNECTOR COMPONENT

CROSS REFERENCE TO RELATED APPLICATIONS

This application is the US National Stage of International Application No. PCT/EP2014/065278 filed Jul. 16, 2014, and claims the benefit thereof, and incorporated by reference herein in its entirety.

FIELD OF THE INVENTION

The present invention relates to a component of a subsea electrical connector, in particular to a component in form of an electrical insulation for electrical conductor, and to a method of manufacturing a component of a subsea electrical connector.

BACKGROUND

Subsea electrical connectors for use underwater are known, and are for example described in the document GB 2 192 316 A. A first connector part of the subsea electrical connector has at least one pin projecting from a support which is inserted into a housing and fixed in place by a retainer ring. The pin has an axially extending conductive core, for example a copper core, which is surrounded by an insulating sleeve which is arranged to expose an area of the conductive core at or near the tip of the pin for making electrical contact with a contact socket in the second connector part of the subsea electrical connector.

In the demated condition of the first and second connector parts, the pin is exposed to the external environment and thus for example to seawater when deployed subsea. The insulating sleeve is intended to insulate the conductive core of the pin from exposure to the external environment. In the mated condition of the first and second connector parts, a portion of the pin and thus the insulating sleeve can still be exposed to surrounding seawater. Since such electrical subsea connectors can have a lifetime of more than 25 years, the insulation of the conductive core can experience long term subsea exposure. Electrophoresis may lead to an intrusion of seawater into the insulation. Furthermore, when such subsea connector is used for high voltage applications, high electrical stresses can occur in proximity to the pin of the connector, which can lead to a degradation of the material exposed to such high electrical field stresses, and may finally lead to a failure of such material, for example to the failure of a seal.

To overcome these difficulties, it is proposed in the document U.S. Pat. No. 7,794,254 B2 to make use of a metal or metalized coating formed on the outer surface of an insulating sleeve. The metal or metalized coating can suppress penetration of water into the insulating sleeve and further reduces localized condensing of equipotential electric field lines whereby electrical stresses can be reduced. Long term subsea exposure may lead to corrosion of a metal or metalized coating.

It is desirable to make subsea connectors less prone to corrosion, and to provide at the same time protection against water ingress into the electrically insulating material. Furthermore, it is desirable to reduce electrical stresses and in particular to protect components of the connector from such stresses and to avoid an electrical breakdown e.g. at insulation interfaces. Such breakdown may for example occur if the electrical field leaves the insulation material. Furthermore, it is desirable that the subsea electrical connector and its components are relatively simple and cost efficient to manufacture.

SUMMARY

Accordingly, there is a need for improving components of a subsea electrical connector, and in particular to protect such component from corrosion while at the same time providing resistance against water permeation into insulation material.

This need is met by the features of the independent claims. The dependent claims describe embodiments of the invention.

According to an embodiment of the invention, a component of a subsea electrical connector is provided, the component being made of an electrically insulating material. The component comprises a protective coating applied to at least a portion of the electrically insulating material for preventing water permeation into the electrically insulating material. The protective coating provided on the electrically insulating material comprises a ceramic coating.

The inventors of the present application have found that a ceramic coating can be applied to the electrically insulating component, which is made of a electrically insulating material, and that the permeation of sea water into the component can be prevented by such coating. In particular, when used as a high voltage insulator, water molecules may be drawn towards the high voltage source, and permeation of water into the electrically insulating material may thus occur by means of electrophoresis. This may reduce the performance of the insulation, and may lead to an electrical short through the insulation material, and finally may lead to a failure. By means of the ceramic coating, a physical barrier to the sea water may be provided, so that the electrically insulating material is protected from such water permeation. Furthermore, the protective coating may provide an earth shield, so that the electrical field may not leave the electrically insulating material, thereby preventing the attraction of sea water towards the high voltage source and thus into the electrically insulating material. Even further, such coating may be very corrosion resistant. The properties of the coating may not suffer from long term subsea exposure, since ceramic material is very inert and robust. Such type of protective coating may significantly improve the properties of the component and thus the properties of the subsea electrical connector.

In an embodiment, the protective coating may consist of the ceramic coating, i.e. it may not comprise further coatings. A relatively simple structure of the component may thus be achieved, and the manufacturing of the component may be facilitated. Furthermore, by providing no additional coatings, such as metal coatings, the suitability for long term subsea exposure can further be improved.

The electrically insulating material may be a plastic material or a composite material, in particular a polymer material. In an embodiment, the plastic material may be PEEK (Polyetheretherketone). PEEK may have enhanced properties regarding the use as an electrical insulator for high voltage in a subsea application.

Other types of plastic material or composite material may be used in different embodiments, such as thermoplastic material, any type of synthetic or semi-synthetic organic solids that are moldable, fiber reinforced materials, in particular glass fiber or carbon fiber reinforced materials, resin materials and the like.

In an embodiment, the electrically insulating material is an electrical isolator, it may have a (volume) resistivity of more than $10^6$ Ωm, in particular more than $10^9$ Ωm, advantageously more than $10^{10}$ Ωm. As an example, PEEK with a volume resistivity of about $10^{14}$ Ωm may be used.

The ceramic coating may be a Ti (titanium)-based ceramic coating. By using titanium oxide as a ceramic material, a protective coating having high resistance against surrounding sea water and high chemical stability may be obtained. Furthermore, using such material may enable the thermal spraying of the ceramic coating. Such coating may also be applied by Aerosol Deposition (AD), which is also termed Aerosol Deposition Method (ADM).

The ceramic layer may for example comprise at least 50%, advantageously at least 70%, more advantageously at least 98% titanium oxide. This may comprise sub-stoichiometric phases, i.e. the ceramic coating may comprise oxygen vacancies in the crystal lattice. As an example, the ceramic coating may be made of about 98% $TiO_2$ and TiO compositions a balance of other materials, such as impurities and the like.

In other embodiments, different types of ceramic coatings may be used, such as Al-based ceramic coatings comprising a relatively large fraction of $Al_2O_3$, Zr-based coatings and the like. Mixtures of different types of ceramic material may also be used, such as a mixture of $TiO_2$ and $Al_2O_3$.

In an embodiment, the ceramic coating is a conductive ceramic coating. Accordingly, the ceramic coating may not only prevent the water permeation into the component, but may also provide electrical shielding. In particular, the ceramic coating may be adapted to provide an earth screen. Since the ceramic coating is applied to the electrically insulating material of the component, it may be prevented that the electrical field escapes the insulation provided by the component, due to the intimate contact between the conductive ceramic coating and the electrically insulating material. Accordingly, in this way, the electrical field can be controlled in the insulation; in particular the electrical field may be contained within the electrically insulating material. Since the electrically insulating material, such as plastic material, in particular PEEK, may itself have a high breakdown strength, an electrical breakdown due to the high electrical stresses may be prevented. Furthermore, the electrically insulating material can be provided in a uniform and/or controlled geometry, thus further enabling the control and confinement of the electrical field within the component.

Also, by keeping the electrical field confined to the component by means of the conductive ceramic coating, the varying geometry of further connector parts, such as seals and the like which may be located around the component and which can increase the electrical stress as the field direction changes, can be prevented, thus preventing the degradation of such parts due to high electrical stresses.

In particular, the bulk ceramic material of the ceramic coating may be conductive. The coating may be applied such that the bulk ceramic material becomes conductive. As an example, this may be achieved by adjusting the parameters during the application of the ceramic coating, e.g. by adjusting the $H_2$ content of the atmosphere during plasma spraying, by cooling during spraying and the like. As another example, such coating may be applied by aerosol deposition. Accordingly, no additional layers, such as metal layers, need to be provided for providing the earth screen. Problems regarding the corrosion of such metal layers can thus be avoided. Control of electrical stresses can thus be provided in an effective and efficient manner, and the component can be produced time and cost efficiently.

As an example, the ceramic coating may have an electrical resistivity of less than 1 Ωm, advantageously less than 0.1 Ωm, more advantageously less than 0.01 Ωm. It may for example be about 0.003 Ωm and below. In other applications, a ceramic coating having a conductivity similar to that of earth control screens for cables (which use semiconductor layers) may be used, it may thus have a resistivity up to 1 Ωm. The conductivity may lie within the range of about 0.001 Ωm to about 1 Ωm.

In an embodiment, the protective coating consists of the ceramic coating which is directly applied to the electrically insulating material of the component. By not making use of any intermediate layer, manufacturing of the component may be facilitated. Furthermore, by applying a conductive ceramic coating in intimate contact with the electrically insulating material, the electrical field can be confined to within the electrically insulating material.

The ceramic coating may be made up of multiple (thin) layers of ceramic material. Even with a remaining degree of porosity, a high degree of protection against the permeation of sea water into the electrically insulating material may be achieved this way. The multiple thin layers of the ceramic material may effectively form a single layer ceramic coating.

In an embodiment, the protective coating may be applied to the electrically insulating material by thermal spraying, in particular by plasma spraying, or by aerosol deposition. By making use of thermal spraying, relatively uniform layers which have very good adhesion properties towards the electrically insulating material surface onto which they are sprayed may be obtained. A high degree of control of the uniformity and thickness of the layers may thus be achieved. Furthermore, by thermally spraying the layer directly to the electrically insulating material, a cost effective coating may be obtained with a relatively low environmental impact, since the processing chemicals which might be required in a conventional plating process can be reduced or may not even be required. Furthermore, such thermal spraying process may be adjusted in order to produce a conductive or a non-conductive ceramic coating. Aerosol deposition may similarly achieve good adhesion between the coating and the electrically insulating material and may result in a dense and relatively uniform ceramic coating.

For spraying, a $TiO_2$ powder of small grain size may for example be used. Grain sizes of the powder may for example lie within a range of about 5 to about 50 micrometers. For aerosol deposition, smaller grain sizes of nanometer scale may be used (e.g. 0.05 to 1 micrometer).

The protective coating may be applied by using a hydrogen plasma spray, a nitrogen plasma spray or a high velocity oxygen field (HVOF) spray, or by using aerosol deposition.

In an embodiment, the ceramic coating is applied to the component of electrically insulating material by repeated application of ceramic layers, e.g. by thermal spraying or aerosol deposition. These individual ceramic layers may be relatively thin (compared to the final layer thickness), so that the ceramic coating can be built up of these thin layers. The mismatch of the porosity of the layer surfaces counteracts the permeation of seawater through the ceramic layer into the electrically insulating material. A single ceramic coating having improved properties against water permeation can thus be obtained. Protection may be improved by increasing the thickness of the ceramic coating, for example by adding further thin ceramic layers.

The ceramic coating may have a thickness of between about 20 and about 400 micrometers, advantageously between about 30 and about 300 micrometers. In some embodiment, the thickness may be between about 50 and about 200 micrometers.

Furthermore, the ceramic coating may have a surface that is post machined or ground after the deposition by thermal spraying or aerosol deposition. The desired surface finish may thus be obtained.

In an embodiment, the component is an electrical insulation of an electrical conductor of the subsea electrical connector. In particular, the component may be an insulating sleeve around an electrical conductor of a pin of the subsea electrical connector. The protective coating may be provided at an outer face of the insulating sleeve, in particular to a portion of the insulating sleeve which is exposed to surrounding seawater when the subsea electrical connector is deployed subsea.

In an embodiment, the coating is earthed. In particular, it may be connected to an earth conductor of the subsea electrical connector. By connecting the coating to earth (or ground), the ceramic coating may effectively confine the electrical field of the electrical conductor to within the electrically insulating material, thus reducing electrical stresses. As a further benefit, electrophoresis due to the high voltage potential of the electrical conductor may no longer occur, since the electrical field is shielded.

In an embodiment, the component of the subsea electrical connector further comprises an inner conductive layer provided on at least one section of a radially inner surface of the insulating sleeve. In such configuration, the inner conductive layer is in electrical contact with the electrical conductor of the pin of the subsea electrical connector. Accordingly, electrical stresses in the interface between the insulating sleeve and the electrical conductor of the pin can be reduced or even be avoided. In particular, the interface between the high voltage applied to the electrical conductor and thus to the inner conductive layer and the insulating material of the insulating sleeve is free of air entrapment or contamination or void free or air tight. Such entrapment or contamination generally has a lower breakdown strength than the insulation. Hence, the risk for a partial discharge is reduced, thus improving the insulating properties provided by the insulating sleeve. In such configuration of the insulating sleeve, the insulation of the pin may be placed under greater electrical stress in comparison conventional systems.

The inner conductive layer may comprise at least one of a metal layer, a conductive ceramic layer or a conductive plastic layer. In some embodiments, the inner conductive layer may consist of one of these layers. If the inner conductive layer is a conductive plastic layer, it may have the same base material as the insulating sleeve; as an example, the insulating sleeve may be made of PEEK and the inner conductive layer may be conductive PEEK. In particular, the inner conductive layer may be made of polymer material or a thermoplastic material.

In an embodiment, the component may further comprise a filler that is provided or arrangeable between the inner conductive layer of the insulating sleeve and the electrical conductor. The filler may be a thermally and/or electrically conductive material, in particular a grease or an adhesive. Such filler may provide an electrical connection between the inner conductive layer and the electrical conductor. Additionally or alternatively, a mediator may be provided for establishing such electrical connection, for example a spring loaded contact, like a spring loaded plunger (metal cap with a spring behind it), may provided to mediate the electrical connection.

The inner conductive layer may be provided on the section of the inner surface of the insulating sleeve by plating or by an interference fit. As an example, a piece of conductive tubing may provide the inner conductive layer and may be mechanically connected to the insulating sleeve by an interference fit.

According to a further embodiment of the invention, a subsea electrical connector part comprising an electrical conductor, advantageously for high voltage, and a component configured in accordance with any of the above described embodiments is provided. The component forms an electrical insulation around the electrical conductor. The protective coating is arranged on an outer face of the electrical insulation. Such subsea electrical connector part benefits from the improved protection against seawater permeation into the electrical insulation. Furthermore, such subsea electrical connector part may be suitable for long term subsea exposure due to the corrosion resistance of the protective coating.

The subsea electrical connector part may comprise a pin extending forwardly from a support, the pin comprising the electrical conductor and the electrical insulation around the conductor. The protective coating may be provided at least at a portion of the pin which is exposed to surrounding seawater when the subsea electrical connector part is deployed subsea and mated with a complementary subsea electrical connector part. Such portion of the pin may be exposed for prolonged periods of time to the seawater when the first subsea electrical connector part is mated with the complementary second subsea electrical connector part during long term subsea operation.

The component may for example be an insulating sleeve extending from a base of the pin towards a forward end of the pin. The pin may engage the complementary subsea electrical connector part at the end of the pin, and the pin may partially enter the complementary subsea electrical connector part in the mated state. The protective coating may extend towards the end of the pin to a position located inside the complementary subsea electrical connector part in the mated state. It may thus be prevented that any part of the insulating sleeve is exposed to seawater when the subsea connector is deployed subsea in the mated state.

According to a further embodiment of the invention, a method of manufacturing a component of a subsea electrical connector is provided. The method comprises providing the component of the subsea electrical connector, the component being made of an electrically insulating material, and applying a protective coating to at least a portion of the electrically insulating material for preventing water permeation into the electrically insulating material, wherein the protective coating comprises a ceramic coating.

By means of such method, a component may be obtained which has advantages similar to the ones outlined further above.

In an embodiment, the step of applying the protective coating comprises a repeated deposition of (thin) ceramic layers directly onto the electrically insulating material of the component in order to build up the ceramic coating, for example by thermal spraying or aerosol deposition.

The protective coating may consist of the single ceramic coating that is obtained by the repeated deposition of the ceramic layers. The ceramic coating may thus be built up layer by layer. Subsequent layers are of course be deposited onto the already built up layers. The initial layer and thus the single ceramic coating are in direct contact with the electrically insulating material, in particular with the plastic or composite material.

In an embodiment, the step of applying the protective coating may comprise the step of thermal spraying of the ceramic coating and of adjusting the parameters of the thermal spraying such that a conductive ceramic coating is obtained. In particular, a coating may be applied the bulk ceramic material of which is conductive. In another embodiment, the step of applying the protective coating may comprise the step of depositing the ceramic coating by aerosol deposition and of adjusting the parameters of the aerosol deposition and/or the properties of the material to be deposited such that a conductive ceramic coating is obtained.

In an embodiment, the component is an insulating sleeve, and the method further comprises providing an inner conductive layer on at least one section of a radially inner surface of the insulating sleeve. Improved electrical properties between the electrical conductor and the inner conductive layer being a high voltage potential during operation and the insulation provided by the insulating sleeve may thus be obtained.

The step of providing the inner conductive layer on at least one section of the radially inner surface may comprise plating the section of the radially inner surface, e.g. plating with a metal layer, or providing an interference fit between the conductive layer and the radially inner surface, e.g. between a piece of tubing made of conductive plastic material.

Providing an interference fit between the conductive layer and the radially inner surface may comprise the steps of heating the insulating sleeve so that its diameter expands; inserting a tube made of a conductive material into the expanded diameter of the insulating sleeve; and connecting the insulating sleeve to the tube by means of cooling down of the heated insulating sleeve, thus providing a fixed connection between the tube and the insulating sleeve, wherein the tube represents the inner conductive layer. A fast and efficient way of providing the inner conductive layer may thus be achieved.

The method may further comprise the step of providing at least a second inner conductive layer on at least a further section of the radially inner surface of the insulating sleeve. The second inner conductive layer may be provided by plating (e.g. metal layer) or spraying (e.g. conductive ceramic layer). The second inner conductive layer may be a metal layer or a conductive ceramic layer. The further section of the insulating sleeve may for example be a tapered section or region, in particular it may be an inner tapered region (i.e. a region in which the inner diameter of the insulating sleeve changes with axial position). Such method may facilitate the application of the second inner conductive layer in such tapered region, and may further facilitate the electrical contacting of the first inner conductive layer.

In further embodiments of the method, the method may be performed such that a component of a subsea connector in any of the above described configurations may be obtained. Furthermore, method steps described above with respect to the component or the subsea electrical connector part may be comprised in embodiments of the method. Further, any features described with respect to the subsea electrical connector part are equally applicable to embodiments of the component and vice versa.

It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

The foregoing and other features and advantages of the invention will become further apparent from the following detailed description read in conjunction with the accompanying drawings. In the drawings, like reference numerals refer to like elements.

DETAILED DESCRIPTION

Figure 1:
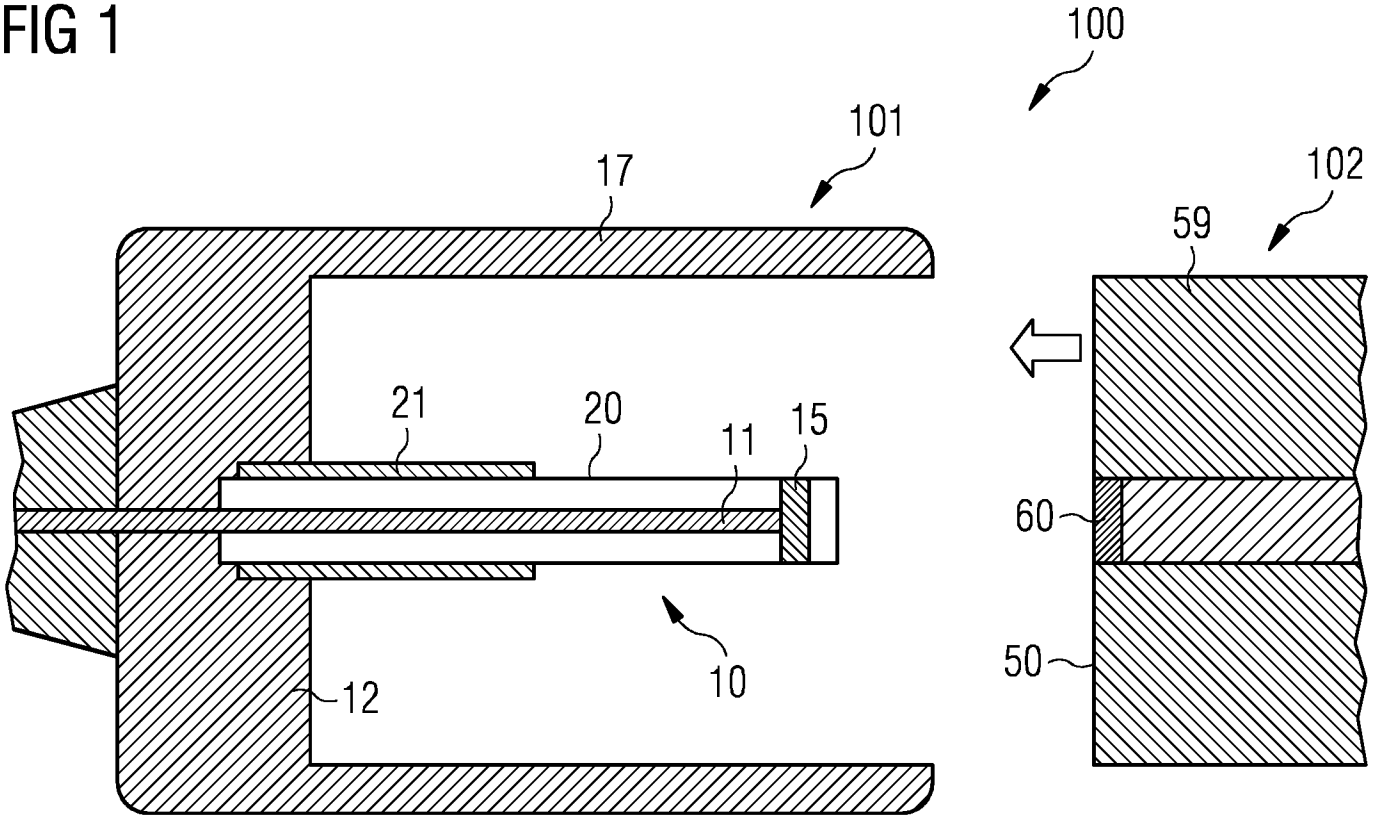
FIG. 1 is a schematic drawing showing a sectional view of a subsea electrical connector including a component according to an embodiment of the invention.

In the following, embodiments of the invention will be described in detail with reference to the accompanying drawings. It is to be understood that the following description of the embodiments is given only for the purpose of illustration and is not to be taken in a limiting sense.

It should be noted that the drawings are to be regarded as being schematic representations only, and elements in the drawings are not necessarily to scale with each other. Rather, the representation of the various elements is chosen such that their function and general purpose become apparent to a person skilled in the art.

FIG. 1 shows a sectional view of a subsea electrical connector 100 including a first subsea electrical connector part 101 and a complementary second subsea electrical connector part 102. In the embodiment shown in FIG. 1, the first connector part 101 is a receptacle part which is receiving the second connector part 102, which is a plug part. The first connector part 101 includes a support 12 from which a pin 10 extends in a forward direction. Pin 10 may also be termed receptacle pin since it is located inside the receptacle 17. The plug part 102 has a plug body 59 with a front surface 50 and a shuttle pin 60, which is pushed into the plug body 59 when the first and second connector parts 101, 102 are engaged and brought into the mated position. Mating occurs in the direction of the arrow illustrated in FIG. 1. During mating, the pin 10 enters the plug body 59 and pushes back the shuttle pin 60, which exposes a socket contact (not shown) which makes electrical contact with a contact portion 15 located in proximity to the tip of pin 10. The electrical conductor 11 provides electrical contact to the contact portion 15 inside the pin 10. The electrical conductor 11 is in particular a conductive core of the pin 10.

Subsea electrical connector 100 is a wet-mateable subsea connector, in which the first and second connector parts 101, 102 can be engaged and disengaged at a subsea location. In an exemplary application, the subsea electrical connector 100 is deployed at a subsea location and is mated, whereafter it remains in the mated state for a prolonged period of time, e.g. several years, thus experiencing long term subsea exposure. Subsea connector 100 may be a high voltage subsea electrical connector for voltages in excess of 1.000 Volt, for example for voltages in the range between about 5.000 and about 80.000 Volt. In some embodiments, the subsea electrical connector 100 may comprise further pins 10, e.g. for providing further electrical connections or for providing a three-phase electrical connection.

The first subsea electrical connector part 101 includes a component 20 which is made of an electrically insulating material, the electrically insulating material being a plastic material. It should be clear that other types of electrically insulating materials may be used in other embodiments. The component 20 provides the electrical insulation for the electrical conductor 11 of the pin 10. The component 20 may for example be an insulating sleeve provided around the electrical conductor 11 of pin 10. As can be seen from FIG. 1, the insulating sleeve extends forwardly from the support 12 along most of the pin's longitudinal extension.

The component 20 comprises a protective coating 21. Protective coating 21 covers a portion of the outer surface of component 20, it covers in particular a portion of component 20 which is exposed to seawater when the first subsea electrical connector part 101 is deployed subsea. The protective coating 21 extends from a portion at which the outer surface of the protective coating 21 is sealed against the support 12 in a direction forwardly of the support. Accordingly, at the base of the pin 10, the plastic material of component 20 cannot come into contact with surrounding seawater.

When the second subsea electrical connector part 102 is mated with the first connector part 101, the outer surface of a forward portion of pin 10 is sealed against the body 59. The protective coating 21 extends forwardly from the support 12 to a position which, when the first and second connector parts 101, 102 are mated, is located inside the plug body 59 behind such seal. Accordingly, when the subsea electrical connector 100 is in the mated position, the plastic material of component 20 is at the front portion of pin 10 also not exposed to surrounding sea water. The part of pin 10 which is exposed to sea water in the mated position of first and second connector parts 101, 102 is entirely covered by the protective coating 21. This way, the plastic material of component 20 can be protected from the surrounding sea water, Water permeation into the plastic material, for example through electrophoresis, can be prevented effectively by means of the protective coating 21.

Protective coating 21 comprises or advantageously consists of a ceramic coating. By means of such ceramic coating, a high degree of resistance against corrosion can be achieved. Furthermore, the ceramic coating may be a conductive ceramic coating. The coating may be applied in such way that the bulk ceramic material of the coating is electrically conductive. The ceramic coating may furthermore be earthed, it may for example be connected to a ground or earth conductor. As an example, the support 12 or the housing of the receptacle part 101 of the subsea electrical connector 100 may be grounded or earthed, and the ceramic coating 21 may be connected thereto. The ceramic coating thus creates an earth screen which is in intimate contact with the plastic material of component 20. Accordingly, the electrical field generated by the current flowing through the electrical conductor 11 can be confined to within the electrical insulation provided by component 20, which plastic material can have a high break down strength. Furthermore, the component 20 has a controlled and uniform geometry, thereby avoiding high electrical stresses. In particular, high electrical stresses at the seals between pin 10 and support 12, or pin 10 and plug body 59 may be prevented by means of the conductive ceramic coating.

The protective coating 21 which can consist of the ceramic coating can be applied by thermal spraying or by aerosol deposition. Examples include nitrogen plasma spraying, hydrogen plasma spraying, or high-velocity oxygen fuel (HVOF) spraying methods. Other spraying methods, which may for example using argon as a carrier gas may also be used. Ceramic powder for example $TiO_2$ or $Al_2O_3$ having a small grain size may be used for thermal spraying. In order to obtain a conductive ceramic coating, the spraying parameters may be adjusted. As an example, the $H_2$ concentration may be increased during plasma spraying or by using compressed air cooling during spraying. Cooling may for example prevent crack formation during spraying, thus increasing the conductivity of the ceramic coating.

In particular, the coating may be applied to the component 20 as described in the publication "Development of electrically conductive plasma sprayed coatings on glass ceramic substrates", Gadow, R.; Killinger, A.; Floristán, M.; Fontarnau, R.; Surface & Coatings Technology 205, Issue 4 (2010), 1021-1028, the contents of which is herein incorporated by reference in its entirety. By making use of the described methods and parameters, the conductivity and porosity of the ceramic coating may be adjusted as desired.

When using aerosol deposition (AD) to apply the protective coating 21, a fine ceramic powder may be mixed with a carrier gas in an aerosol chamber and flown through a micro orifice nozzle for deposition on the component 20. A powder with a grain size between about 0.05 micrometer and about 1 micrometer may for example be employed. The aerosol deposition may for example be performed as described in 'Substrate heating effects on hardness of an a-Al2O3 thick film formed by aerosol deposition method', M. Lebedev et al., Journal of Crystal Growth 275 (2005) e1301-e1306, the contents of which is herein incorporated by reference in its entirety.

The ceramic coating may be applied by a subsequent application of thin ceramic layers. The ceramic coating may thus be built up by ceramic layers applied on top of each other. Protection against permeation of surrounding seawater can thus be improved.

The thickness of the ceramic coating and thus of the protective coating 21 may be between about 50 and about 200 micrometers, depending on the application and the desired coating properties. For thin coatings, coating thickness may for example be increased to increase protection against seawater permeation. A coating thickness of about 30 micrometer showed to be sufficient to achieve good protection against seawater permeation.

After application of the ceramic coating, the coating may be post-machined or grounded, for example to a pre-defined thickness and to obtain the desired surface finish.

In embodiments, the protective coating 21 consists only of the single ceramic layer. In other embodiments, it may comprise further layers, such as a bonding layer between the plastic material of component 20 and the ceramic layer, or a top layer, for example for further improving the resistance against seawater permeation.

By means of the protective coating 21 in form of the ceramic coating, several advantages can be achieved. A hard wearing coating is obtained that resists impact, abrasion and the like. The coating is immune to corrosion, in particular immune to aqueous corrosion at the respective deployment temperatures. Furthermore, it is resistant to degradation from most types of chemical attack. Also, it can be used in a wide thermal range, the inventors have tested the coating from −60 degree Celsius to +230 degree Celsius. Also, the application of the ceramic coating by plasma spraying achieves a strong adhesion between the plastic material of component 20 and the ceramic coating. Further, a higher degree of control over uniformity and thickness is obtained. The ceramic coating further provides an effective thermal barrier to the substrate. Due to the reduction in processing chemicals, the coating is cost effective and has a smaller environmental impact compared to a plating solution. Also, by adjusting the process parameters, it is possible to produce conductive or non-conductive versions of the coating, so that the coating is very versatile.

Optionally, the component 20 in form of the insulating sleeve may comprise an inner conductive layer (not shown) that is provided on at least one section of a radially inner surface of the insulating sleeve. The insulating sleeve has in some embodiments a through hole into which the electrical conductor 11 is inserted during assembly. The inner surface in this through hole can partly or completely be covered with the inner conductive layer. The conductive layer can be applied by plating of a metal layer. A layer of conductive plastic material, such as conductive PEEK may also be used. In the latter case, the component may be manufactured by providing a tube made of the conductive plastic material, heating the insulating sleeve, sliding the thus expanded insulating sleeve over the tube and letting the assembly cool to generate a interference fit. The inner portion of the tube may then be machined to correspond to the outer diameter of the electrical conductor 11.

A filler may be provided between the insulating sleeve and the electrical conductor 11 in order to ensure good thermal conductivity. Furthermore, a good electrical connection can be established between the inner conductive layer and the electrical conductor 11 by means of an electrically conductive filler material, or some other component, such as the above described mediator.

In other embodiments, the insulating sleeve may be formed by overmolding the electrically insulating plastic material over the electrical conductor 11.

It should be clear that the component 20 may not only be implemented as an insulating sleeve for the electrical conductor 11, but may also be implemented in other portions of the subsea electrical connector 100. As an example, plastic material that is used at other portions of the first or second connector parts 101, 102 for electrical insulation or that is exposed to seawater might be provided with the ceramic coating and thus implement the component 20. Due to the good adhesion and the good mechanical properties of the ceramic coating, protection from surrounding sea water may also be provided to components of plastic material that are not used for electrical insulation or do not suffer from electrical stresses. A non-conductive ceramic coating may be used in these cases.

Figure 2:
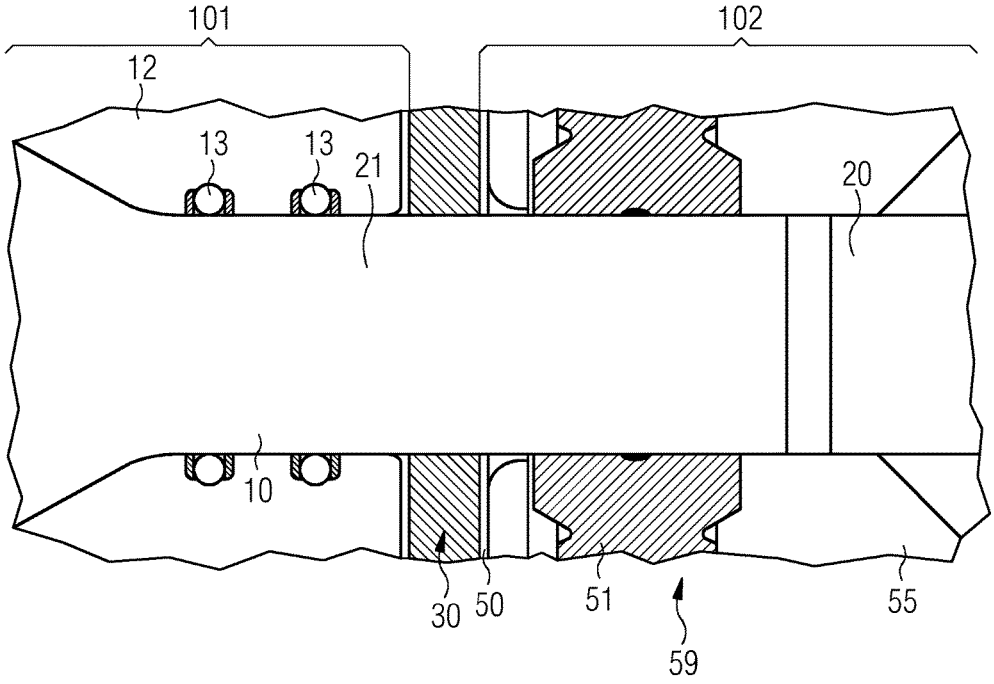
FIG. 2 is a schematic drawing showing a partly sectional view of a subsea connector including a component according to an embodiment of the invention.

FIG. 2 illustrates in more detail a particular embodiment of the subsea electrical connector 100 of FIG. 1. The explanations given above thus also apply to the embodiment of FIG. 2. As can be seen, the pin 10 is at its base portion wider than at the portion projecting forwardly from the support 12. The component 20, which is again the insulating sleeve of the pin 10, is provided with the protective coating 21, advantageously consisting of the ceramic coating, in a rear part of the pin 10. As can be seen, sealing is provided by O-rings 13 between the support 12 and the pin 10, in particular with the outer surface of the ceramic coating. FIG. 2 shows the first connector part 101 and the second connector part 102 in the mated position. The pin 10 has entered the plug body 59. The plug body 59 comprises the seal 51 which initially seals against the shuttle pin 60 and in the mated state illustrated in FIG. 2 seals against the pin 10. As can be seen, the protective coating 21 extends beyond the seal 51 into the plug body 59. Accordingly, the portion of component 20 that is not covered by the protective coating 21 is not exposed to seawater in the mated state which is illustrated in FIG. 2.

In the rear part of the plug body 59, an incompressible fluid such as insulating oil 55 is provided.

As can be seen in FIG. 2, there is a space or gap between the surface of support 12 from which the pin 10 projects, and the front surface 50 of the plug body 59. In the mated state of FIG. 2, seawater 30 is present in this space or gap. By means of the protective coating 21, it is ensured that only the protective coating 21 is exposed to the seawater 30, but not the plastic material of component 20.

When electric current is present in the electrical conductor 11 (not illustrated in FIG. 2), electrophoresis may cause water molecules to permeate into the plastic material of component 20. If the ceramic coating is a conductive ceramic coating and is earthed, it shields the electrical field generated by the current so that the effect of electrophoresis is no longer present. Further, it provides a physical barrier to the seawater.

Figure 3:
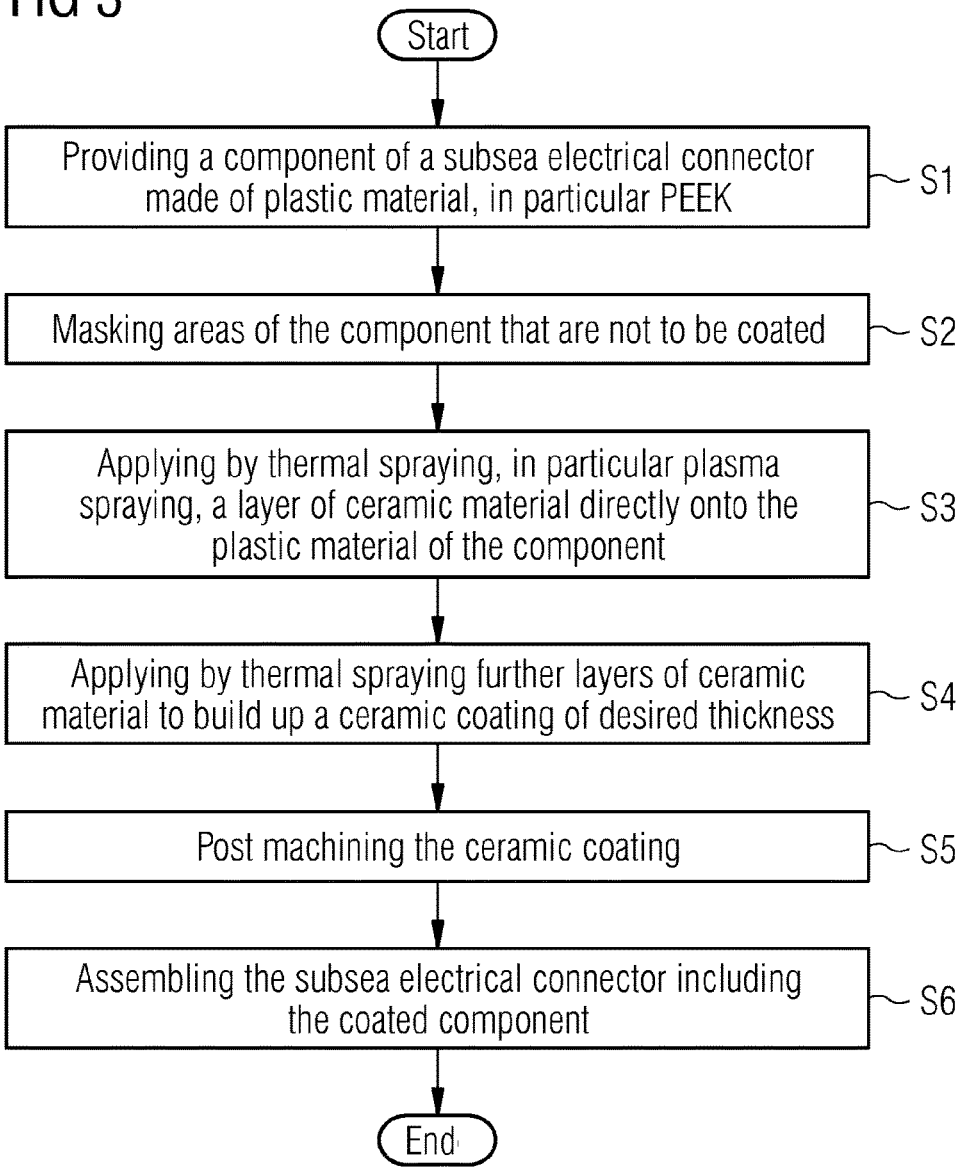
FIG. 3 is a flow diagram illustrating a method of manufacturing a component according to an embodiment of the invention.

FIG. 3 illustrates a method of manufacturing a component of a subsea electrical connector according to an embodiment of the invention. In step S1, a component of the subsea electrical connector is provided. The component is made of plastic material, in particular of PEEK. The component may for example be part of the electrical insulation of the connector, for example an insulating sleeve. In the optional step S2, areas of the component that are not to be coated are masked. Note that masking is only one option, and in other embodiments, the protective coating may simply be applied selectively to certain areas instead of masking, for example if the spraying process has a high enough spatial resolution.

In step S3, the component is provided with a protective coating by applying by thermal spraying, in particular by plasma spraying, a layer of ceramic material directly onto the plastic material of the component. In step S4, further layers of ceramic material are applied by thermal spraying, thus building up a ceramic coating of desired thickness.

In step S5, the ceramic coating is post-machined. This can be done to achieve a desired surface finish, or to achieve a desired coating thickness. After manufacturing the component, it may be assembled into the subsea electrical connector (optional step S6).

It should be clear that modifications may be made to the method of manufacturing the component 20. As an example, further layers may be provided, such as an intermediate adhesive layer, or a top coating or the like or the ceramic coating may be applied by spraying only a single layer of ceramic material.

While specific embodiments are disclosed herein, various changes and modifications can be made without departing from the scope of the invention. The present embodiments are to be considered in all respects as illustrated and non-restrictive, and all changes coming within the meaning and equivalency range of the appended claims are intended to be embraced therein.

The invention claimed is:

1. A method of manufacturing a component of a subsea electrical connector, comprising:

providing the component of the subsea electrical connector, wherein the component is an insulating sleeve, the component being made of an electrically insulating material, applying a protective coating to at least a portion of the electrically insulating material for preventing water permeation into the electrically insulating material, wherein the protective coating comprises a ceramic coating;

providing an inner conductive layer on at least one section of a radially inner surface of the insulating sleeve by plating the section of the radially inner surface or providing an interference fit between the conductive layer and the radially inner surface;

wherein providing an interference fit between the conductive layer and the radially inner surface comprises:

heating the insulating sleeve so that its diameter expands;

inserting a tube made of a conductive material into the expanded diameter of the insulating sleeve;

connecting the insulating sleeve to the tube by cooling down of the heated insulating sleeve, thus providing a fixed connection between the tube and the insulating sleeve, wherein the tube represents the inner conductive layer.

2. The method according to claim 1, wherein applying the protective coating comprises:

repeated deposition of ceramic layers onto the electrically insulating material of the component in order to build up the ceramic coating.

3. The method according to claim 2, wherein the repeated deposition of ceramic layers is by thermal spraying or aerosol deposition.

4. A method of manufacturing a component of a subsea electrical connector, comprising:

providing the component of the subsea electrical connector, wherein the component is an insulating sleeve, the component being made of an electrically insulating material, applying a protective coating to at least a portion of the electrically insulating material for preventing water permeation into the electrically insulating material, wherein the protective coating comprises a ceramic coating, providing an inner conductive layer on at least one section of a radially inner surface of the insulating sleeve by plating the section of the radially inner surface or providing an interference fit between the conductive layer and the radially inner surface, and providing, plating, or spraying, at least a second inner conductive layer on at least a further section of the radially inner surface of the insulating sleeve.

5. The method according to claim 4, wherein the second inner conductive layer comprises a metal layer or a conductive ceramic layer.

6. The method according to claim 4, wherein applying the protective coating comprises:

repeated deposition of ceramic layers onto the electrically insulating material of the component in order to build up the ceramic coating.

7. The method according to claim 6, wherein the repeated deposition of ceramic layers is by thermal spraying or aerosol deposition.

* * * * *